US009296242B2

(12) United States Patent
Williams, Jr.

(10) Patent No.: US 9,296,242 B2
(45) **Date of Patent: *Mar. 29, 2016**

(54) TAG MATERIAL

(75) Inventor: Robert E. Williams, Jr., Collinsville, IL (US)

(73) Assignee: Sev-Rend Corporation, Collinsville, IL (US)

( * ) Notice: Subject to any disclaimer, the term of this patent is extended or adjusted under 35 U.S.C. 154(b) by 223 days.

This patent is subject to a terminal disclaimer.

(21) Appl. No.: 12/924,735

(22) Filed: Oct. 4, 2010

(65) Prior Publication Data

US 2011/0086188 A1 Apr. 14, 2011

Related U.S. Application Data

(60) Provisional application No. 61/278,379, filed on Oct. 6, 2009.

(51) Int. Cl.
*B41M 5/30* (2006.01)

(52) U.S. Cl.
CPC ..... *B41M 5/30* (2013.01); *B41M 2205/04* (2013.01); *B41M 2205/42* (2013.01)

(58) Field of Classification Search
None
See application file for complete search history.

(56) References Cited

U.S. PATENT DOCUMENTS

| | | | | |
|---|---|---|---|---|
| 4,121,856 | A * | 10/1978 | Brunette | 462/66 |
| 4,221,063 | A | 9/1980 | Charles et al. | |
| 4,643,122 | A | 2/1987 | Seybold | |
| 5,030,492 | A | 7/1991 | Kurtin | |
| 5,154,971 | A | 10/1992 | Mizutani | |
| 5,154,972 | A | 10/1992 | Mizutani | |
| 5,156,708 | A | 10/1992 | Mizutani | |
| 5,346,738 | A | 9/1994 | Samonides | |
| 5,763,058 | A | 6/1998 | Isen et al. | |
| 6,010,771 | A | 1/2000 | Ien et al. | |
| 6,020,286 | A * | 2/2000 | Gumbiowski et al. | 503/227 |
| 6,537,656 | B1 * | 3/2003 | Dontula et al. | 428/314.4 |
| 6,806,453 | B1 | 10/2004 | Vincent et al. | |

* cited by examiner

*Primary Examiner* — Sheeba Ahmed
(74) *Attorney, Agent, or Firm* — Paul M. Denk

(57) ABSTRACT

A reinforced two-side-printable laminate material constructed of a top layer of coated-one-side paper or related material, a middle layer of foamed polypropylene film or related material, and a bottom layer of paper material, said bottom layer being coated with a direct thermal emulsion with the thermal emulsion facing outward.

2 Claims, 1 Drawing Sheet

TAG MATERIAL

CROSS REFERENCE TO RELATED APPLICATION

This non provisional patent application claims priority to the provisional patent application having Ser. No. 61/278,379, having filing date Oct. 6, 2010.

FIELD OF THE INVENTION

The tag material of this invention relates to the use of laminate components which when adhesively adhered together form a tag type material that can be imprinted with various indicia and product information for use in the marketing of products to the trade.

BACKGROUND OF THE INVENTION

This present invention provides a laminate tag material for use for any number of tag applications. The tag material is reinforced and printable on two sides, with one side being printable by a direct thermal printer.

Styles of tag material have been readily available in the art and for use for providing information relative to various marketed products. For example, paper tags have long been used in the art. Polymer type tags have become more prominent, because of their durability, and have now been designed for accepting print material. A combination of these types of components formulated into tag, has not apparently been to any extent, and therefore, providing a tags that is readily acceptable of print indicia, or other information, and yet is very durable during usage, and can withstand rough handling, is a welcome addition in the art.

SUMMARY OF THE INVENTION

The tag material consists of three layers bonded by an adhesive. The first, or top, layer of the tag material is formed of paper or related material. The first layer is laminated or bonded by adhesive to the top face of the second, or middle layer. The second layer will typically be formed of a foamed polypropylene film for reinforcement, but it may also be formed of another polymer material depending on desired form and function. The third, or bottom, layer is formed of paper or related material that has been coated with a direct thermal emulsion, with the thermal emulsion facing outward. The third layer is laminated or bonded by adhesive to the bottom face of the second layer.

The resulting tag laminate is compatible with being printed on a direct thermal printer. The caliper of the finished material construction may vary, according to the desired use of the tag, by using differing calipers of constituent base materials.

DESCRIPTION OF THE PREFERRED EMBODIMENT

Figure 1:
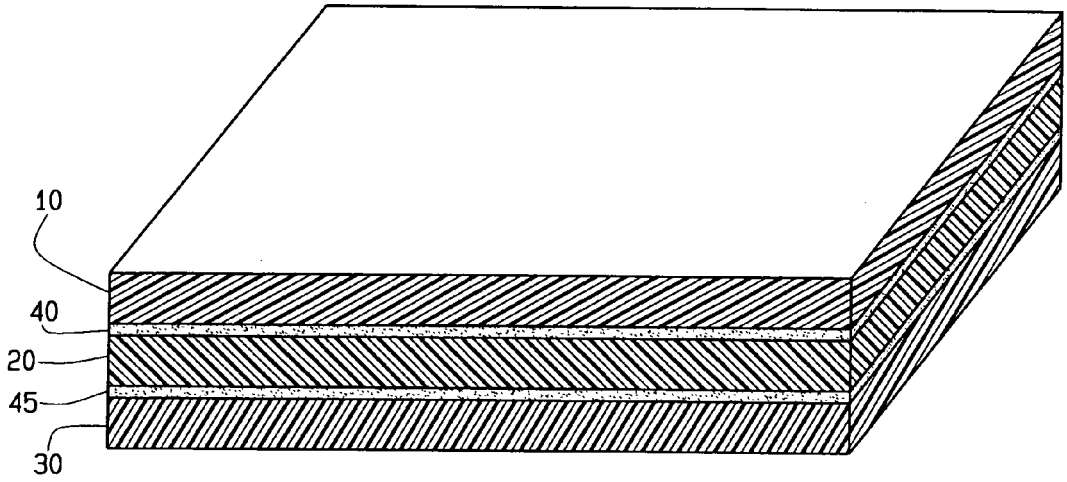
FIG. 1 is a perspective view of a section of the tag material, showing the three layers of the material bonded by layers of adhesive.

With reference to the drawings:

FIG. 1 is a perspective view of the tag material of the present invention. As can be seen and understood, the material is composed generally of three layers bonded by a laminating adhesive. The resulting laminate has a top face and a bottom face, as does each constituent layer in the laminate. In the preferred embodiment, top layer 10 is a coated-one-side (C1S) paper. Top layer 10 is bonded to middle layer 20 by a layer of bonding adhesive 40. In the preferred embodiment, middle layer 20 is a layer of foamed polypropylene. As noted, the middle layer 20 may also be of another polymer material, according to the intended use and application of the tag. Middle layer 20 provides reinforcement to the laminate. Bottom layer 30 is bonded by adhesive layer 45 to the bottom face of middle layer 20. In the preferred embodiment, bottom layer 30 is formed of paper that has been coated on its bottom face with a direct thermal emulsion.

By way of explanation, CSD is an acronym formed from the first letter of the description of each layer making up the tag material. C—Coated 1 Side Paper/S-Sheen (another name for the foamed polypropylene)/D—Direct Thermal Paper.

Thickness ranges of the three layers:

Top Layer—2-4 mil

Inner (Poly) Layer—1-6 mil

Bottom (thermal) Layer—2-5 mil

Thermal Emulsion—The direct thermal paper used on the CSD tags is commercially available direct thermal paper. We currently use Kanzaki brand 3.2 mil KIP-370 thermal paper though we have used other direct thermal papers in the past. There are a variety of foreign and domestic suppliers that catalog a number of direct thermal papers and films that could potentially be used for this application. Thermal emulsions and formulas are proprietary to the manufacturer.

Laminating Adhesive—We are currently using Airflex 426 water based laminating adhesive manufactured by Air Products. There are a variety of adhesive suppliers with various adhesive formulas that could be used for this type of lamination.

Figure 2:
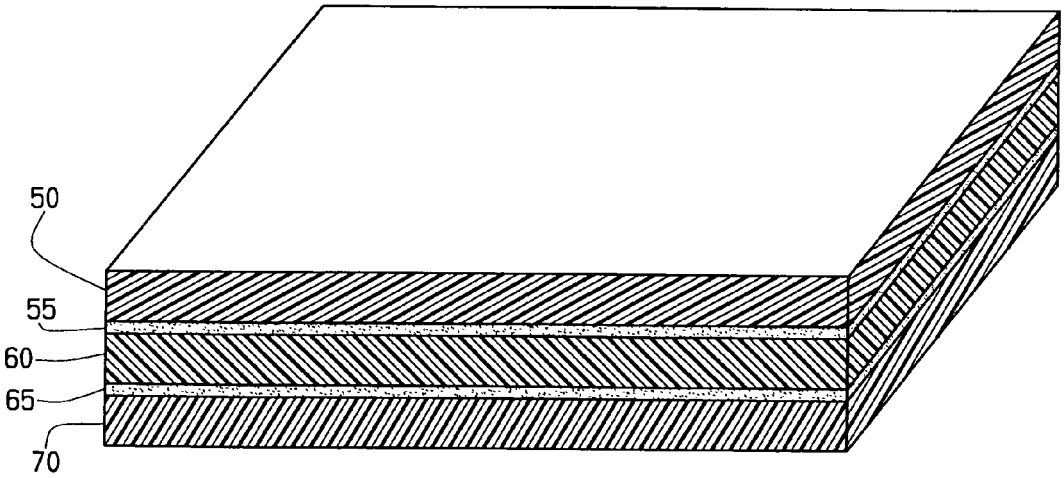
FIG. 2 is a perspective view of a modified tag material also formed of three layers.

In a modification to this invention, and as shown in FIG. 2, the three layered tag is formed of material generally constructed of a top layer 50 formed of a clear polypropylene or related laminate material bonded to the emulsion side of a micro-encapsulated carbonless paper layer 60 being bonded by an adhesive 55, which paper layer 60 inturn is bonded to the uncoated side of a coated 1 side (C 1S) paper 70. This bonding also is attained by means of an adhesive 65. In referring to FIG. 2, the resulting construction is a laminated, two side printable tag material with both sides being printable by traditional printing methods such as flexo, of said, Rotgravure, and the like. Additional, the laminated micro-encapsulated side of the tag is capable of being imaged without the use of inks or dyes by either metal stamping or embossing the surface of the tag. The total tag caliber is reliant on the sum of the caliber of the three different layers and can be customized for specific applications by varying the calibers of one or more of the different components. In additional layer of clear laminate, as with the FIG. 1 embodiment, may be adhered to the coated side of the C1S paper for additional print protection.

This tag material of the current invention is designed for usage for a number of tag applications. The top layer of the tag will be formed of a clear laminate which inturn is laminated or bonded with adhesive to emulsion side of a micro-encapsulated paper, which comprises the second on inner layer of the tag material. The second or inner layer is then laminated or bonded with adhesive to the uncoated side of the third or bottom layer, which is formed, as a foresaid, of the coated one side (C1S) paper. The laminated, micro-encapsulated surface of the tag creates the unique the feature of the resulting tag material that is capable of be printed without the use of inks or dyes by either metal stamping or embossing the surface of the tag.

Variations or modifications to the subject matter of this invention may occur to those skilled in the art upon reviewing the disclosure as provided herein. Such variations, within the spirit of this development, are intended to be encompassed within the scope of any invention as provided herein. The description of the preferred embodiment as set forth herein is done so for illustrative purposes only.

The invention claimed is:

1. A material for making tags printable on two sides, said material comprising a laminate with a top face and a bottom face, said laminate comprising a top layer of paper material, said paper material comprising a coated-one-side paper, with the coated side of the paper comprising its top surface, said top layer having a thickness between about 2 to 4 mils;

a middle reinforcing layer of foamed polypropylene film, said middle layer bonded to the bottom surface of the top layer by a layer of bonding adhesive applied between the top surface of said middle layer and said bottom surface of said paper top layer, said middle reinforcing layer having a thickness between about 1 to 6 mils;

a bottom layer of paper material, said bottom layer having been coated with a direct thermal emulsion, with said thermal emulsion facing outwardly so that it remains exposed, said bottom layer bonded to the bottom surface of said middle layer by a layer of bonding adhesive applied between the top surface of said bottom layer and said bottom surface of said middle layer, said bottom layer having a thickness between about 2 to 5 mils; and said bonding adhesive being a water based laminating adhesive.

2. The material of claim 1, wherein the middle layer also includes a polymer film of polyethylene.

* * * * *